United States Patent [19]

Guy et al.

[11] Patent Number: 4,705,414

[45] Date of Patent: Nov. 10, 1987

[54] PRINTHEAD MOUNTING AND MOVEMENT CONTROL ASSEMBLY

[75] Inventors: Jon S. Guy, Garden Grove; Dean-Yuan Liu, Canoga Park; Albert A. Sholtis, Long Beach, all of Calif.

[73] Assignee: Sanders Associates, Inc., Nashua, N.H.

[21] Appl. No.: 9,659

[22] Filed: Jan. 28, 1987

Related U.S. Application Data

[63] Continuation of Ser. No. 765,076, Aug. 13, 1985, abandoned.

[51] Int. Cl.[4] ..... B41J 3/20

[52] U.S. Cl. ..... 400/120; 346/76 PH; 400/711

[58] Field of Search ..... 400/55, 56, 57, 58, 400/59, 120, 212, 215, 215.3, 216, 216.1, 240.3, 249, 257, 711; 346/76 PH

[56] References Cited

U.S. PATENT DOCUMENTS

| | | | |
|---|---|---|---|
| 3,855,448 | 12/1974 | Hanagata et al. | 400/120 X |
| 4,225,251 | 9/1980 | Klimek et al. | 400/120 X |
| 4,421,428 | 12/1983 | Noda et al. | 400/120 |
| 4,563,692 | 1/1986 | Negita et al. | 346/76 PH |

FOREIGN PATENT DOCUMENTS

| | | | |
|---|---|---|---|
| 2045849 | 5/1972 | Fed. Rep. of Germany | 400/215 |
| 3446010 | 6/1985 | Fed. Rep. of Germany | 400/120 |
| 201686 | 12/1982 | Japan | 400/240.3 |
| 184685 | 10/1984 | Japan | 400/120 |
| 2151557 | 7/1985 | United Kingdom | 400/120 |

*Primary Examiner*—Charles Pearson

*Attorney, Agent, or Firm*—William F. Porter, Jr.

[57] ABSTRACT

An assembly for positioning a print head so as to transfer ink from an ink ribbon to a printing medium positioned on a movable platen adjacent to said ribbon supports the print head on a rocker member which enables the head to be swung between a print position wherein it engages the ink ribbon and a feed position wherein the head is spaced from the ribbon enabling ribbon to be moved. The rocker is rocked to move the head between its two positions by a rotary cam driven by a small low-power electric motor. When the cam engages the rocker member at selected angular positions, the head is maintained in its retracted feed position; otherwise, the head resides in its print position. The assembly also includes provision for detecting the angular position of the cam so as to produce signals to facilitate repositioning the cam and head promptly.

1 Claim, 3 Drawing Figures

PRINTHEAD MOUNTING AND MOVEMENT CONTROL ASSEMBLY

This application is a continuation of application Ser. No. 765,076, filed Aug. 13, 1985, now abandoned.

This invention relates to a print head mounting and movement control assembly. It relates more particularly to such a mounting and control assembly for use especially in a thermal printer or recorder which prints in multiple colors on successive paper sheets mounted to a platen.

BACKGROUND OF THE INVENTION

In a typical plural color thermal printer, successive sheets of paper are fed from a sheet source to a platen such as a rotary drum. Each sheet is wrapped around the drum and rotated into position opposite a thermal print head located adjacent to the drum. The print head has a plurality of addressable vertical wires and a single horizontal wire on its surface closest to the drum. By sending current to the horizontal wire and one of the addressable wires, the intersection of the two wires can be heated at a selected point along the length of the drum.

A spooled print ribbon having a plurality of color bands in a repeatable sequence is disposed to pass between the print head and the drum. Often, the ribbon has color bands corresponding to the primary subtractive colors cyan, magenta and yellow and sometimes black. The colors are present on the ribbon as a thin heat-transferable coating on the side of the ribbon facing the drum.

In a typical thermal printer, after a sheet of paper is wrapped around the drum, the drum is rotated to position the sheet at a "top-of-sheet" position opposite the print head. Also, the print ribbon is positioned so that the top of the first color band is located at the top of the paper sheet. A mechanism then moves the print head so that it presses the ribbon and paper sheet against the drum. Immediately thereafter, the print wires of the print head are addressed sequentially across the head according to control signals from a controller representing a line of print information. The wires of the print head are thus heated at selected pixel locations or points along the drum causing spots or dots of wax of the first color on the print ribbon to be melted into the paper sheet along the first line to be printed. Next, the paper sheet and ribbon are advanced one line by rotating the drum and ribbon spool. The wires of the print head are again energized selectively by the controller to print the second line of dots of the first color on the paper sheet. This print-and-feed sequence is repeated until the sheet is completely printed with the first color.

Following this, the head is retracted from the ribbon and the drum is rotated so that the top of the sheet is again opposite the print head and the print ribbon is advanced to place the top of its second color field in alignment for printing on the first line of the sheet. The head is then repositioned against the ribbon and the above-described print-and-feed sequence is repeated until the paper sheet has been completely printed with the second color, after which the sheet is again returned to the top-of-sheet position opposite the print head to receive the third color. This process is continued until all of the colors have been printed on the sheet. The printed sheet is then removed from the drum to be replaced by the next sheet to be printed on.

It can be appreciated from the foregoing discussion that, when printing on each sheet, the print head must be removed repeatedly between its "print" position wherein it presses the print ribbon and paper sheet against the drum and its "feed" position wherein the print head is retracted from the drum so that the print ribbon and drum can be moved relative to the print head. Such movements occur when the sheet is mounted to the platen and positioned for printing the first color, when the sheet is repositioned prior to printing each successive color and after completion of printing when the sheet is being removed from the drum.

Invariably, in printers of this general type, the print head is shifted between its aforesaid two operative positions by a solenoid and return spring type of mechanism. The print head is moved to its print position against the drum when the printer controller energizes the solenoid and the print head returns to its retracted feed position when the current applied to the solenoid is reduced to the point where the force of the solenoid is overcome by the return force of the spring. The use of this type of mechanism to move the print head has several disadvantages. More particularly, in order to move the print head promptly and reliably, the solenoid has to be quite massive and heavy so that its presence has a pronounced effect on the size and weight of the printer as a whole. Also, the solenoid has to be on or energized during the entire print cycle and this increases considerably the overall power requirements of the printer. Such a large solenoid also creates excessive heat in the printer which can degrade the performance of the print ribbon and other components of the printer. Additionally, in some prior printers, the movements of the head are not controlled closely enough. Resultantly, the head may sometimes be instructed to print when it is not quite in its print position or the drum may be advanced when it is still engaged by the head, thus spoiling the quality of the printing or causing a jam.

SUMMARY OF THE INVENTION

Accordingly, the present invention aims to provide an improved print head mounting and movement control assembly especially for use in a thermal printer.

Another object of the invention is to provide such an assembly which achieves very prompt and reliable positioning of the print head between its two operative positions.

Still another object of the invention is to provide an assembly of this type which moves the print head between its two operative positions at just the right times in the printing cycle.

A further object of the invention is to provide a print head mounting and movement control assembly which is energy efficient.

Another object of the invention is to provide a print head mounting and movement control assembly for a printer which generates a relatively small amount of heat in the printer.

Yet another object of the invention is to provide an assembly of this type which is relatively easy and inexpensive to incorporate into a thermal printer and to service during the useful life of the printer.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, in accordance with our invention, the print head of a rotary drum-type thermal printer is mounted to one end of a rocker which is pivotally mounted to a base. The pivot axis of the rocker is positioned parallel to the rotary axis of the drum so that, when the other end of the rocker is moved up and down, the print head is moved toward and away from the drum between its print and feed positions.

The rocker is moved up and down by a rotary cam which is rotated by a small low-power electric gear motor under the control of the printer controller. That is, the rocker other end is spring biased against the cam so that it follows the cam surface. Preferably, when a low point on the cam is presented to the rocker end, the print head is moved to its print position against the platen and, when the rocker end is engaged by a high point on the cam surface, the print head is moved to its retracted feed position. It is apparent, therefore, that the cam only has to rotate and thus its motor only has to be energized in order to move the print head between its two positions. No current is applied to the motor when the print head is residing in either of its two operative positions. Therefore, the present assembly requires minimal energy in order to properly position the print head.

Additional energy savings arise because only a small low-power electric motor is required in order to rotate the cam to position the head. By the same token, the small motor generates essentially no heat that could degrade the operation of the printer.

The present assembly also monitors the position of the head for control purposes by sensing the angular position of the cam and applying corresponding position signals to the printer controller in order to move the head to its correct position in a minimum amount of time and to maintain the head in that position. In this way, when the head is in its feed position, a thermal printing operation will assuredly not occur; but, when the head is in its print position, the controller knows immediately that it may commence a printing operation. Thus the controller compares the current position of the head with the commanded position in a servo control arrangement insuring that the head has moved promptly to its correct position before any printer control functions dependent upon that position are initiated. This enables the printer to print at maximum speed with minimum printing malfunctions and jams. Yet, as will be seen presently, the assembly is composed of relatively few metal parts which are relatively inexpensive to make in quantity. Also, as noted above, the motive source for positioning the head can be a small, inexpensive electric motor. Therefore, the cost is minimal of incorporating the present print head mounting and movement control assembly into an otherwise standard printer.

BRIEF DESCRIPTION OF THE DRAWING

For a fuller understanding of the nature and objects of the invention, reference should be had to the following detailed description, taken in connection with the accompanying drawing, in which.

DETAILED DESCRIPTION OF THE PREFERRED EMBODIMENT

For purposes of this description, we will describe our print head mounting and movement control assembly in the context of a rotary drum-type thermal printer. It should be understood, however, that the principles of the invention may be applied to position other types of print heads which are required to be shifted toward and away from a platen during the course of printing on a recording medium positioned on the platen.

Figure 1:
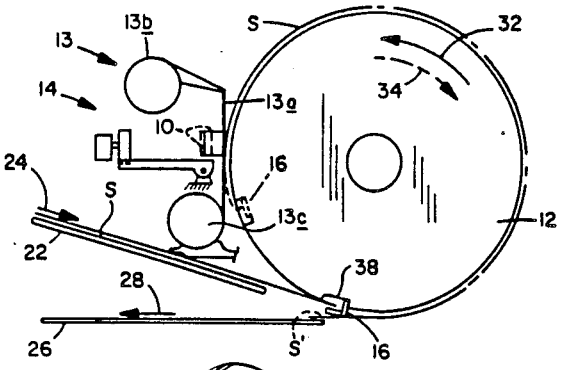
FIG. 1 is a schematic diagram in cross section showing printing apparatus incorporating the print head mounting and movement control assembly embodying our invention.

Turning first to FIG. 1 of the drawing, color printing apparatus includes a print head 10 which is positioned opposite a rotary drum 12 by an improved print head mounting and movement control assembly indicated generally at 14. Positioned between the print head 10 and drum 12 is a print ribbon cartridge shown generally at 13. The cartridge includes a print ribbon 13*a* composed of a sequence of different-color bands that is stretched between a motor-driven take-up spool 13*b* and a let-off spool 13*c*. The cartridge has windows so that the segment of its ribbon 13*a* opposite the print head is exposed to both the print head and drum 12. Supported on drum 12 is a sheet of paper S shown in dot-dash lines whose leading edge is secured to the drum by a clip 16 incorporated into the drum. During operation of the printer, assembly 14 moves head 10 between a print position shown in solid lines wherein it presses ribbon 13*a* and sheet S against the drum and a feed position shown in dotted lines wherein the head is retracted from the drum so that the ribbon and drum can be moved relative to the head. Typically, the printing apparatus is designed to print on a standard size sheet S (e.g. $8\frac{1}{2}\times 11$ inches). Therefore, the head, print ribbon and drum are at least $8\frac{1}{2}$ inches long and the drum has a circumference in excess of $11\frac{1}{2}$ inches.

The printing apparatus includes a paper sheet feed path in the form of a guide 22 for guiding a paper sheet S shown in solid line from a paper sheet source (not shown) in the direction of arrow 24 such that its leading edge is directed into clip 16 when the clip is open as shown in solid lines in FIG. 1. The apparatus also has a paper discharge path in the form of a second guide 26 positioned with one end adjacent clip 16 when the drum 12 is oriented as in FIG. 1 to receive the paper sheet S as it is ejected from clip 16 in the direction of arrow 28. The clip, ribbon cartridge and the means for operating them in synchronism with the rotation of drum 12 are not parts of the present invention. Therefore, they will not be described in detail here. For fuller descriptions of them, see co-pending application Ser. No. 765,079, of even date herewith, filed in the names of Jon S. Guy and Dean Yuan-Liu, entitled THERMAL PRINTER, now U.S. Pat. No. 4,594,597, which application is owned by the assignee of the present application. Suffice it to say, drum 12 is rotatable in both directions by the drive means. Counterclockwise rotation as indicated by the arrow 32 in FIG. 1 shall be referred to as the "printing direction" and clockwise rotation as shown by the dot-dash arrow 34 in the same figure shall be referred to as the "release direction". When drum 12 is oriented so that clip 16 is positioned as shown in solid lines in FIG. 1, the drum is deemed to be in its "release position". When rotating the drum in the printing direction of arrow 32, the drive means of the apparatus is arranged to stop the drum also in a "top-of-sheet" position in which the closed clip 16 is located adjacent to the print head 10 as indicated by the dot-dash lines in FIG. 1 so that the print head is positioned to print the first line on the paper sheet S.

In describing the operation of the apparatus, we will assume that drum 12 is stopped at its release position and clip 16 is open as shown in solid lines in FIG. 1. With the clip in that position, a paper sheet S can be fed along guide 22 in the direction of arrow 24 so that its leading edge is received in the gap 38 present between the clip and the drum surface. After that occurs, drum 12 is rotated through a small angle in the release direction to close clip 16, thereby clamping that edge to the drum. Drum 12 is then rotated in the printing direction indicated by arrow 32 to its top-of-sheet position so that sheet S becomes wrapped around the drum as indicated by the dot-dash lines in FIG. 1. The circumference of drum 12 is related to the length of sheet S and the placement of guide 26 such that, when the drum is in its top-of-sheet position, the trailing edge margin S' of sheet S rests on the paper guide 26 as shown in FIG. 1.

The printing apparatus now commences the first printing sequence. First, the positioning and control assembly 14 under the control of the printer controller (not shown) moves the print head 10 to its print position shown in solid lines in FIG. 1 so that it presses print ribbon 13*a* and the sheet S against the surface of drum 12. Immediately thereafter, the wires of print head 10 are energized selectively and the drum stepped around following the above-described print and feed sequence until all of the line positions on sheet S are printed with first color dots. Then head 10 is moved to its retracted feed position by assembly 14 while drum 12 continues rotating in the printing direction indicated by arrow 32 to its top-of-sheet position. At the same time, ribbon cartridge 13 is driven to advance the ribbon 13*a* to bring the beginning of the second color band opposite the print head wires.

At this point, assembly 14 returns print head 10 to its solid line print position to commence printing the second color on sheet S. This process is repeated until the sheet has been printed with all of the colors present on the print ribbon 13*a*, with head 10 being retracted by assembly 14 between the printing of each color.

Upon completion of printing, drum 12 is rotated once again to its top-of-sheet position placing the tail end S' of the sheet on guide 26 as shown in dotted lines in FIG. 1. Drum 12 is now rotated in its release direction shown by arrow 34 in FIG. 1 causing the sheet wrapped around the drum to be pushed outward along the paper guide 26 in the direction of arrow 28. When the drum reaches its release position shown in FIG. 1, clip 16 is opened as shown, thereby releasing the leading edge of the sheet so that the sheet is ejected along guide 26 to the exit end of the printing apparatus.

Figure 2:
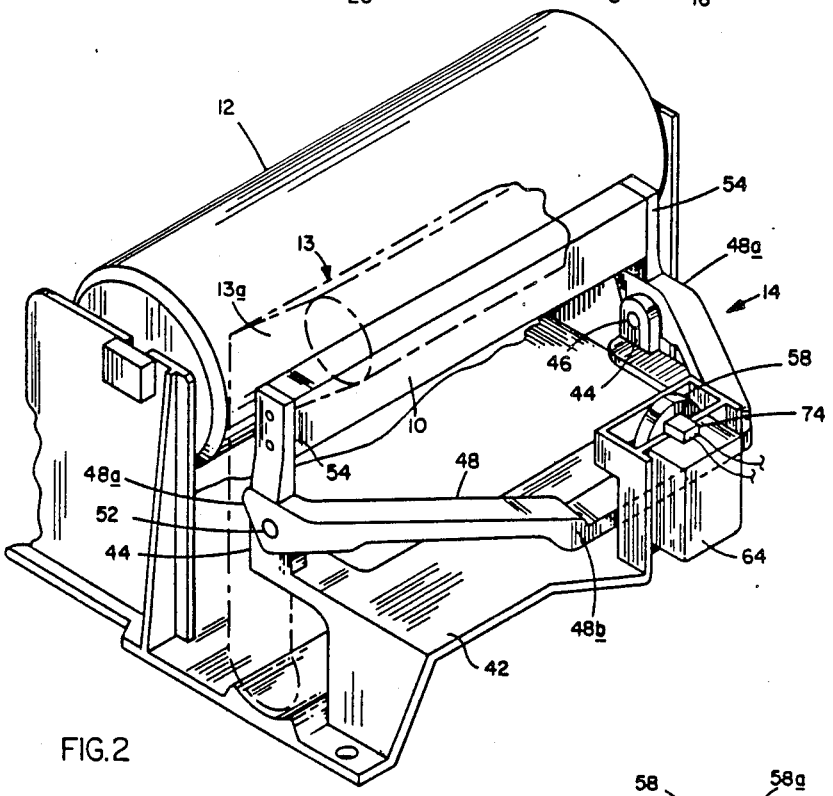
FIG. 2 is a fragmentary perspective view on a much larger scale illustrating that assembly in greater detail.

Turning now to FIG. 2, assembly 14 includes a suitable base or frame 42 which may also constitute the mounting for drum 12 and cartridge 13 as shown. A pair of ears 44 having lateral pivot holes 46 project up from the opposite edges of the frame. The ears are positioned so that their pivot holes 46 define a pivot axis which is parallel to the rotary axis of drum 12. Assembly 14 also includes a generally U-shaped yoke 48 having opposite end segments 48*a* which are parallel to one another and connected by pivot pins 52 to ears 44 of the base so that the bridging portion 48*b* of the yoke extends away from drum 12. A pair of upstanding parallel arms 54 are mounted endwise to the yoke end segments 48*a* very close to pivot pins 52 and the print head 10 is supported between the upper ends of these arms so that the head is parallel to, and spaced a short distance from, the drum surface, with the print ribbon 13*a* being located in the gap between the print head and the drum.

The yoke 48 and arms 54 together constitute a rocker. Thus, when the bridging portion 48*b* of yoke 48 is moved up away from frame 42, the arms 54 are swung toward drum 12 thereby moving head 10 to its print position against drum 12 as shown in solid lines in FIG. 1. On the other hand, when yoke portion 48*b* is moved down toward base 42, the arms 54 swing head 10 away from drum 12 to its retracted feed position shown in dotted lines in FIG. 1.

Figure 3:
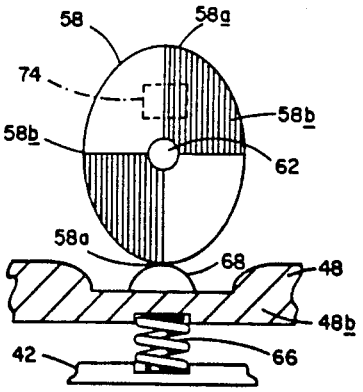
FIG. 3 is a sectional view on a still larger scale of a portion of the FIG. 2 assembly.

Referring to FIGS. 2 and 3, yoke 48 is moved up and down by a cam 58 having an axle 62 which is rotatively mounted to frame 42 above yoke 48, with the rotary axis of the cam being generally perpendicular to the pivot axis of the yoke. A small low-power electric gear motor 64 is mounted to frame 42 in front of the yoke, with the motor armature being coupled to the cam axle 62 so that, when the motor is energized, the cam rotates directly above the yoke portion 48*b*. As best seen in FIG. 3, a coil spring 66 is captured and compressed between yoke biased upwards against the cam surface of the cam. Preferably, a wear-resistant pad 68 is mounted to the top of yoke portion 48*b* to function as a cam follower. In the illustrated embodiment of the invention, cam 58 is more or less elliptical. That is, it has two high points or peaks 58*a* and two low points or valleys 58*b*. The eccentricity of cam 58 is such that, when the cam is rotated by motor 64 so that one of its peaks 58*a* engages pad 68, the yoke 48 is moved downward so as to swing print head 10 away from drum 12 to its feed position. On the other hand, when the cam is oriented so that one of its valleys or low points 58*b* engages pad 68, the yoke 48 is permitted to pivot upward under the force of spring 66 so that the print head 10 is swung toward drum 12 to its position for printing. During operation of the printing apparatus, the gear motor 64, under the control of the apparatus controller, rotates cam 58 at a suitable speed, e.g., 25–35 RPM, so that the print head 10 is moved promptly and positively between its two operative positions.

While we have specifically shown a cam 58 with two lobes or peaks 58*a*, it should be understood that the cam may have a larger number of peaks and valleys, e.g., four or six, if faster positioning of the head is desired.

It will be appreciated that it takes very little energy to rotate cam 58. The yoke 48 provides a sufficient mechanical advantage to enable the low-power motor to rotate the cam to retract head 10 despite the friction between the cam and the cam follower pad 68 and the return bias on the yoke. Therefore, its motor 64 can be a relatively small inexpensive gear motor which draws minimal current. Resultantly, the power requirements of assembly 14 are much less than those of comparable head positioning assemblies utilizing solenoids which draw high currents and which are required to be on during the entire printing operation. Also, in using such a small motor, the assembly contributes little to the overall size and weight of the printing apparatus and the assembly does not generate any heat in the printer that could cause damage to the print ribbon or other components of the printer.

Referring to FIGS. 2 and 3, in order to insure that the printing apparatus only prints when the print head 10 is in its print position, assembly 14 includes means for monitoring the angular position of ram 58 which, in turn, reflects the position of the print head. More particularly, the surface of cam 58 facing away from drum 12 is divided into sectors 72. In the illustrated cam, there are four equal-size 90° sectors distributed around the cam, there being a boundary between sectors centered on each cam peak 58*a* and a sector boundary centered on each cam valley 58*b*. Alternate sectors, indicated by line hatching, are coated with a material which reflects light. The remaining unhatched sectors do not reflect that light.

Also, mounted to frame 42 directly above motor 64 is an infrared source and detector assembly 74 which sights on the coated face of the cam. Preferably, assembly 74 is an infrared type of assembly that is nonresponsive to light normally present in an office environment. Also, if desired, appropriate shielding (not shown) may be provided around assembly 74 to screen out sunlight. Assembly 74 and motor 64 are connected in a standard servo control loop in the apparatus controller so that the actual position of the cam (and thus of the head 10) can be compared with the position commanded by the controller so that the head is "homed" to its correct position before the controller initiates the various printer functions that are dependent upon head position. For example, the controller insures that the cam is oriented as shown in FIG. 3 so that a boundary between a nonreflective sector on the left and a reflective sector on the right is centered on the detector 74 before it instructs the print head to print on sheet S. Likewise, the controller verifies that the cam is oriented to position a reflective/nonreflective sector boundary opposite detector 74 before it initiates the feeding of a sheet S to, or its discharge from, drum 12 as described above.

Thus, the inclusion of this optical encoding feature in assembly 14 insures that the print head is moved promptly between its two operative positions and that the printing apparatus does not initiate its various functions unless the head is in the correct position. This precise control of print head position encourages high-quality printing and minimizes the likelihood of machine malfunctions and jams. Accrrdingly, printing apparatus incorporating our print head mounting and movement control assembly should fird wide application in printing apparatus and particularly in thermal printers.

It will thus be seen that the rbjects set forth above, among those made apparent frcm the preceding description, are efficiently attained, and, since certain changes may be made in the above corstruction without departing from the scope of the invention, it is intended that all matter contained in the abrve description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A print head mounting and movement control assembly for thermal printing apparatus which prints on a printing medium positioned on a movable platen located adjacent to the assembly, said assembly comprising:

A. a support;

B. a thermal print head;

C. means for pivotally mounting the head to the support for movement between a first position wherein the head is positioned close to the platen for printing and a second position wherein the head is spaced from the platen to enable the platen to receive and discharge printing medium;

D. an elliptical cam having a rotary axis and a peripheral cam surface with camming segments centered on the major and minor axes of said cam;

E. means for mouting the cam to the support for multiple-revolution rotation about said axis so that said cam surface engages said mounting means;

F. means for biasing said head to one of its said positions;

G. motive means for rotating said cam about its said axis in response to command signals, said cam surface being shaped to maintain said head in its said first position except when one of said camming segments engages said mounting means whereupon said head is moved to its second position;

H. code means having alternating light and dark sectors positioned on a surface of the cam that is perpendicular to said rotary axis, the boundaries of said sectors being located at the major and minor axes of the cam and thus correlated directly to the present position of the print head; and I. stationary code reading means positioned opposite said code means to detect said sector boundaries when said cam is rotated continuously by said motive means, said code reading means producing head position signals indicating the present position of the print head for controlling said printing apparatus.

* * * * *